US010746367B2

(12) United States Patent
Paroni et al.

(10) Patent No.: US 10,746,367 B2
(45) Date of Patent: Aug. 18, 2020

(54) VEHICLE LIGHT COMPRISING A PORTION OF LIGHT EMISSION WITH OPALESCENT EFFECT

(71) Applicant: MARELLI AUTOMOTIVE LIGHTING ITALY S.P.A., Turin (IT)

(72) Inventors: Sara Paroni, Turin (IT); Marco Svettini, Turin (IT)

(73) Assignee: MARELLI AUTOMOTIVE LIGHTING ITALY S.P.A., Turin (IT)

( * ) Notice: Subject to any disclaimer, the term of this patent is extended or adjusted under 35 U.S.C. 154(b) by 0 days.

(21) Appl. No.: 15/825,926

(22) Filed: Nov. 29, 2017

(65) Prior Publication Data

US 2018/0149326 A1 May 31, 2018

(30) Foreign Application Priority Data

Nov. 30, 2016 (IT) ..... 102016121517

(51) Int. Cl.
*G09F 13/04* (2006.01)
*G09F 13/08* (2006.01)
(Continued)

(52) U.S. Cl.
CPC ..... *F21S 41/24* (2018.01); *F21S 41/141* (2018.01); *F21S 41/285* (2018.01); *F21S 41/36* (2018.01);
(Continued)

(58) Field of Classification Search
CPC ..... F21S 41/24; F21S 41/141; F21S 41/285; F21S 41/36; F21S 41/20; F21S 41/322;
(Continued)

(56) References Cited

U.S. PATENT DOCUMENTS 10,241,256 B2 * 3/2019 Gollier ..... G02B 6/0068
2006/0083028 A1 * 4/2006 Sun ..... G02B 6/0016 362/615

(Continued)

FOREIGN PATENT DOCUMENTS

EP 1895228 A1 3/2008
EP 2317214 A1 5/2011

(Continued)

OTHER PUBLICATIONS

Search Report for Italian Application No. 201600121517 dated Jul. 20, 2017.

(Continued)

*Primary Examiner* — Jong-Suk (James) Lee
*Assistant Examiner* — Erin Kryukova
(74) *Attorney, Agent, or Firm* — Howard & Howard Attorneys PLLC

(57) ABSTRACT

Vehicle light comprising a container body, a lenticular body, a light guide, including a body having a prevailing longitudinal extension (L) that defines the propagation direction of the light beam inside the body by total internal reflection. The body has a first breakline that extends from the first to the second side wall. The first breakline includes a plurality of first holes that produce, through successive refractions, a scattering the light rays (Ri) towards the light outlet wall so as to emit a light beam with opalescent effect. The first holes are adjacent to each other without interruption, and the first holes of the first breakline are pass-through with respect to a thickness of the body of the light guide, penetrating from a first face to a second face of the body for a depth equal to the thickness.

20 Claims, 8 Drawing Sheets

(51) Int. Cl.

| | |
|---|---|
| ***F21V 7/04*** | (2006.01) |
| ***H01L 23/02*** | (2006.01) |
| ***H01L 23/48*** | (2006.01) |
| ***F21S 41/24*** | (2018.01) |
| ***F21S 43/243*** | (2018.01) |
| ***F21S 43/249*** | (2018.01) |
| ***F21S 41/36*** | (2018.01) |
| ***F21S 43/14*** | (2018.01) |
| ***F21S 43/239*** | (2018.01) |
| ***F21S 43/31*** | (2018.01) |
| ***F21S 41/141*** | (2018.01) |
| ***F21S 41/20*** | (2018.01) |
| ***F21S 43/20*** | (2018.01) |

(52) U.S. Cl.
CPC ..... *F21S 43/14* (2018.01); *F21S 43/239* (2018.01); *F21S 43/243* (2018.01); *F21S 43/249* (2018.01); *F21S 43/26* (2018.01); *F21S 43/31* (2018.01)

(58) Field of Classification Search
CPC ..... F21S 41/33; F21S 41/331; F21S 41/323; F21S 41/333; F21S 41/365; F21S 43/249; F21S 43/31; F21S 43/26; F21S 43/14; F21S 43/239; F21S 43/235; F21S 43/236; F21S 43/237; F21S 43/243; F21S 43/315; F21S 43/241; F21V 5/008; G02B 6/0011; G02B 6/0035; G02B 6/0041; G02F 21/133615
See application file for complete search history.

(56) References Cited

U.S. PATENT DOCUMENTS

| | | | | |
|---|---|---|---|---|
| 2006/0285356 | A1* | 12/2006 | Tseng | G02B 6/0016 362/608 |
| 2007/0109810 | A1* | 5/2007 | Park | G02B 6/002 362/615 |
| 2007/0247862 | A1* | 10/2007 | Tanghe | F21S 41/24 362/498 |
| 2015/0003094 | A1* | 1/2015 | Gebauer | F21S 41/24 362/511 |
| 2016/0116657 | A1* | 4/2016 | Nakashima | G02B 6/001 362/509 |
| 2017/0276316 | A1* | 9/2017 | Kawabata | F21S 43/243 |
| 2019/0078747 | A1* | 3/2019 | Wu | F21S 41/43 |

FOREIGN PATENT DOCUMENTS

| | | | |
|---|---|---|---|
| EP | 2530372 | A1 | 12/2012 |
| EP | 2735789 | A2 | 5/2014 |
| JP | 2015201278 | A | 11/2015 |
| WO | 2015075668 | A1 | 5/2015 |
| WO | 2016022251 | A1 | 2/2016 |

OTHER PUBLICATIONS

European Search Report for European Patent Application No. 17204512 dated Mar. 21, 2018.

* cited by examiner

VEHICLE LIGHT COMPRISING A PORTION OF LIGHT EMISSION WITH OPALESCENT EFFECT

CROSS-REFERENCE TO RELATED APPLICATIONS

The present application claims priority to and all the benefits of Italian Patent Application No. 102016000121517, filed on Nov. 30, 2016, which is hereby expressly incorporated herein by reference in its entirety.

BACKGROUND OF THE INVENTION

1. Field of the Invention

The present invention concerns a vehicle light comprising a portion of light emission with opalescent effect.

2. Description of the Related Art

The term vehicle light is intended indifferently to mean a rear vehicle light or a front vehicle light, the latter also called a headlamp, or headlight.

As is known, a vehicle light is a lighting and/or signaling device of a vehicle comprising at least one external light of the vehicle having a lighting and/or signaling function toward the outside of a vehicle such as, for example, a position light, a direction indicator light, a brake light, a rear fog light, a reversing light, a low beam headlight, a high beam headlight, and the like.

The vehicle light, in its simplest abstraction, includes a container body, a lenticular body, and at least one light source.

The lenticular body is placed to close the mouth of a container body so as to form a housing chamber. The light source is arranged inside the housing chamber, which may be turned so as to emit light toward the lenticular body, when powered by electricity.

The construction of a vehicle light, after assembling the various components, involves fixing and hermetically sealing the lenticular body on the container body.

It is increasingly felt in the art the need to use the vehicle light not only as an instrument to satisfy the requirements of homologation in order to obtain luminous beams that meet particular photometric requirements but also as an instrument of design specific to the vehicle on which the light is employed.

Therefore, the light pattern emitted by the light does not only have the function of fulfilling the signaling and/or lighting function but also that of creating a precise desired light effect. This light effect or pattern more and more represents the leitmotif of some automobile manufacturers who, even via the optical component of the lights, intend to set themselves apart from their competitors.

Such light effects should not, however, compromise the homogeneity of the light beam produced which, although not related to specific photometric requirements, is considered essential by the end users. In other words, a non-homogenous light beam, although meeting the photometric requirements for a light, would be considered an unacceptable "defect" by the end user of the vehicle light.

There are several known ways to ensure homogeneity, such as introducing a lens or filter with opalescent effect.

There are various methods in the art for obtaining the opaline effect on vehicle lights. The most popular use opalescent materials which, when struck by the light beam, are able to generate the light effect of opalescence.

The opaline material is made of a polymeric material that incorporates microspheres made of a different material so as to disperse light randomly.

By virtue of this random diffusion of the beam, it is possible to obtain the opaline effect.

There are, however, some regulations, such as those in the US, prohibiting the use of such materials in the automotive light industry.

It is thus felt in the art the need to provide a vehicle light which produces a light beam that is both homogenous and opalescent at the same time without any use of opaline material.

SUMMARY OF THE INVENTION

Such requirement is satisfied by a vehicle light comprising a container body that delimits a containment seat that houses at least one light source suitable to emit, when electrically powered, a plurality of light rays (Ri) defining a light beam to propagate outside of the vehicle light. A lenticular body at least partially closes the containment seat and is suitable to be crossed by the light beam produced by the light source. A light guide faces, in correspondence of a light inlet wall, toward the at least one light source, so as to receive the light beam from this and transmit it to an light outlet wall, facing the lenticular body. The light guide includes a body having a prevailing longitudinal extension (L) that defines the propagation direction of the light beam inside the body by total internal reflection. A first and a second side wall extend substantially parallel to the prevailing longitudinal extension (L). The body has a first breakline that extends from the first to the second side wall. The first breakline includes a plurality of first holes, defining cylindrical optics, having circular cross-section, or spherical optics suitable to realise cylindrical or spherical caustics that produce, through successive refractions, a scattering of the light rays (Ri) towards the light outlet wall so as to emit a light beam with opalescent effect. The first holes are adjacent to each other without interruption, and the first holes of the first breakline are pass-through with respect to a thickness of the body of the light guide, penetrating from a first face to a second face of the body for a depth equal to the thickness.

BRIEF DESCRIPTION OF THE DRAWINGS

Further features and advantages of the present invention will become more understandable from the following description of its preferred and non-limiting embodiments, wherein.

Elements or parts of elements in common to the embodiments described below are referred to with the same reference numerals.

DETAILED DESCRIPTION OF THE INVENTION

Figure 1:
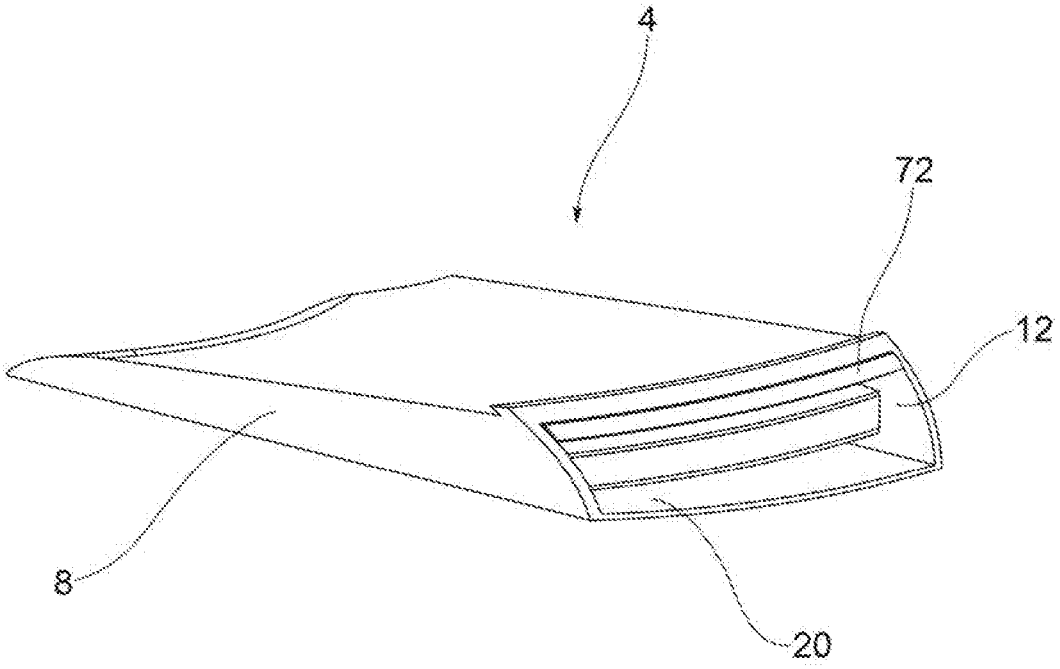
FIG. 1 is a perspective view of the front of a vehicle light according to the present invention in an assembly configuration.
Figure 2:
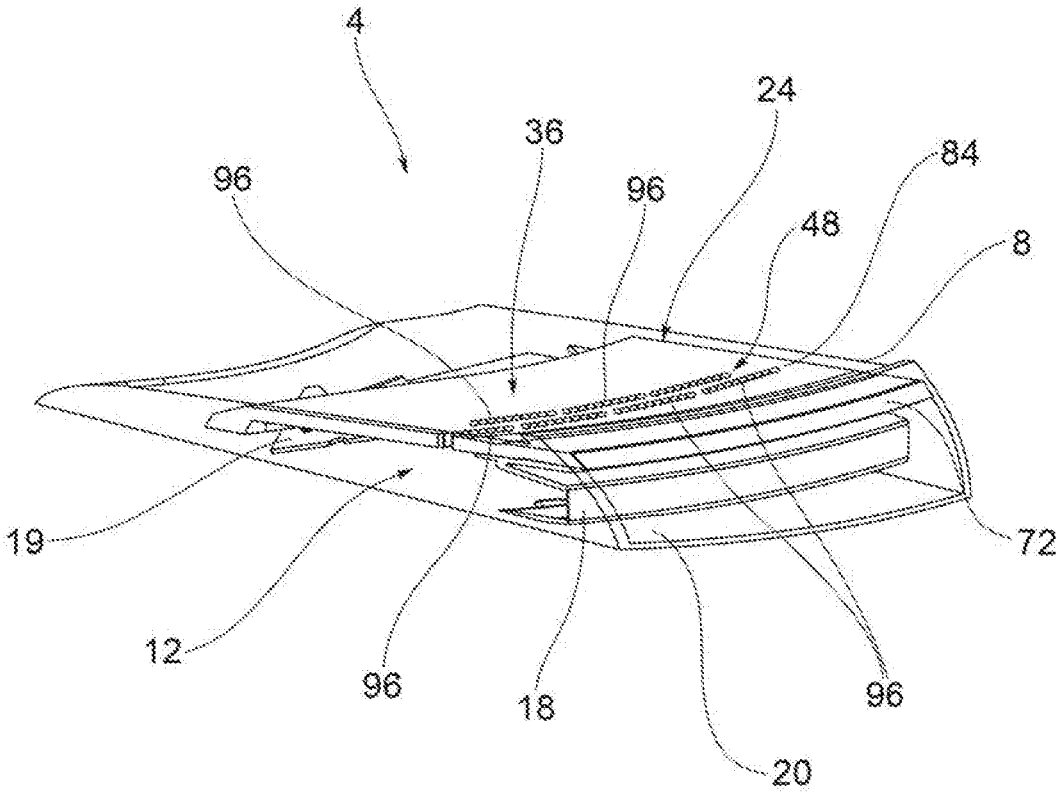
FIG. 2 is a transparent perspective view of the vehicle light of FIG. 1.
Figure 3:
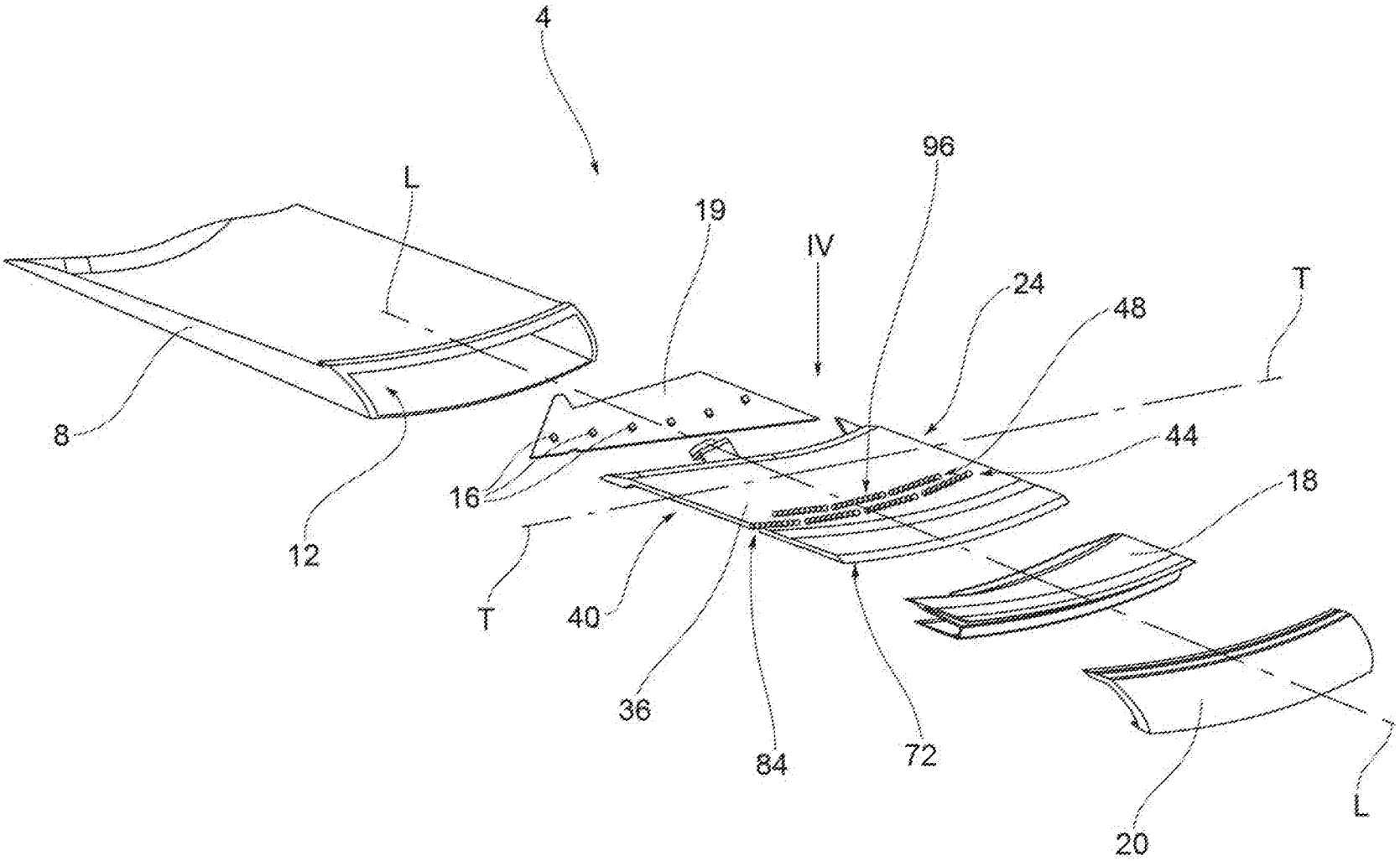
FIG. 3 is a transparent perspective view of the vehicle light of FIG. 1.

With reference to the aforementioned figures, at 4 is collectively indicated a vehicle light to which the following discussion will refer without thereby losing generality.

As mentioned above, the term vehicle light is intended indifferently to mean a rear vehicle light or a front vehicle light, the latter being also called a headlamp, or headlight.

As is known, the vehicle light comprises at least one light outside of the vehicle having a lighting and/or signaling function, as for example a position light, which may be a front, back, side position light, a direction indicator light, a brake light, a rear fog light, a reversing light, a low beam headlight, a high beam headlight, and the like.

The vehicle light 4 comprises a container body 8, usually in polymeric material, which typically allows the vehicle light 4 to be attached to the related vehicle.

For the purposes of the present invention, the container body 8 may have any shape, size and position: for example, the container body 8 may not be directly combined with the bodywork or other attachments of the vehicle that may be combined with it.

According to one embodiment, the container body 8 delimits a containment seat 12 that houses at least one light source 16 suitable to emit, when electrically powered, a plurality of light rays Ri defining a light beam to be propagated outside of the vehicle light 4. For the purposes of the present invention, the type of light source used is irrelevant; preferably, the light source 16 is a light emitting diode (LED) light source.

The housing body 8 may accommodate, in the containment seat 12, intermediate support elements 18 of the various optical and/or electronic components of the vehicle light 4, in a known manner.

For example, the light sources 16 are electrically supported and powered by suitable electronic cards 19, known in the art.

The vehicle light 4 also comprises a lenticular body 20, at least partially counter-shaped to the container body 8.

The lenticular body 20 is attached to the container body 8 so as to close at least partially the containment seat 12 which houses the at least one main light source 16.

For the purposes of the present invention, the lenticular body 20 may be external so as to define at least one outer wall of the vehicle light directly subject to the atmosphere.

It is also possible to provide that the lenticular body 20 is inside a vehicle so as to be housed inside a vehicle interior; this is the case, for example, of a dome light or a light that is part of a dashboard of a vehicle.

The lenticular body 20 closes the containment seat 12 and is suitable to be crossed at least partially by the light beam produced by the main light source 16.

In this regard, the lenticular body 20 is made of at least partially transparent or semitransparent or translucent material, which may also include one or more opaque portions, so as to allow, however, the crossing, at least partial, of a main light beam emitted by the at least one main light source 16.

According to possible embodiments, the material of the lenticular body 20 is a resin such as PMMA, PC and the like.

The vehicle light 4 further comprises a light guide 24 facing, at its light inlet wall 28, the at least one light source 16, so as to receive the light beam from the same and transmit it to a light outlet wall 32, facing the lenticular body 20.

The light outlet wall 32 may be directly or indirectly facing the lenticular body 20: 'directly' means that the light outlet wall 32 is at least partly in front of the lenticular body 20; 'indirectly' means that the light outlet wall 32 is not placed in front of the lenticular body 20 but may direct, on the lenticular body 20, the light beam exiting therefrom, for example through the interposition of a reflective surface.

The light guide 24 comprises a body 36 having a prevailing longitudinal extension L that defines the direction of propagation of the light beam inside the body 36 by total internal reflection, as well as having a first and a second side wall 40, 44 substantially parallel to the prevailing longitudinal extension L.

Advantageously, body 36 has a first breakline 48 extending between the first and the second side wall 40, 44.

Breakline means a portion that disrupts the continuity of the material of body 36 of the light guide 24, so as to achieve a change of means between the material of body 36 and the air contained in the discontinuity, as better described below.

Advantageously, the first breakline 48 comprises a plurality of first holes 52, defining cylindrical optics, having circular cross-section, or spherical optics suitable to produce cylindrical or spherical caustics that produce, through successive refractions, a scattering of the light rays Ri towards the light outlet wall 32 so as to emit a light beam with opalescent effect.

The first holes or optics 52 are side by side without interruption, so as to interpenetrate each other at least partially. In other words, the two first adjacent holes 52 are not completely separated by a portion of the body 36 but share at least partially portions of the respective side walls.

The first holes 52 of the first breakline 48 are pass-through with respect to a thickness 56 of body 36 of the light guide 24, penetrating from a first face 60 to a second face 64 of body 64 by a depth equal to the thickness 56.

For example, the first holes 52 have a diameter ranging from 1 mm to 5 mm.

Figure 7:
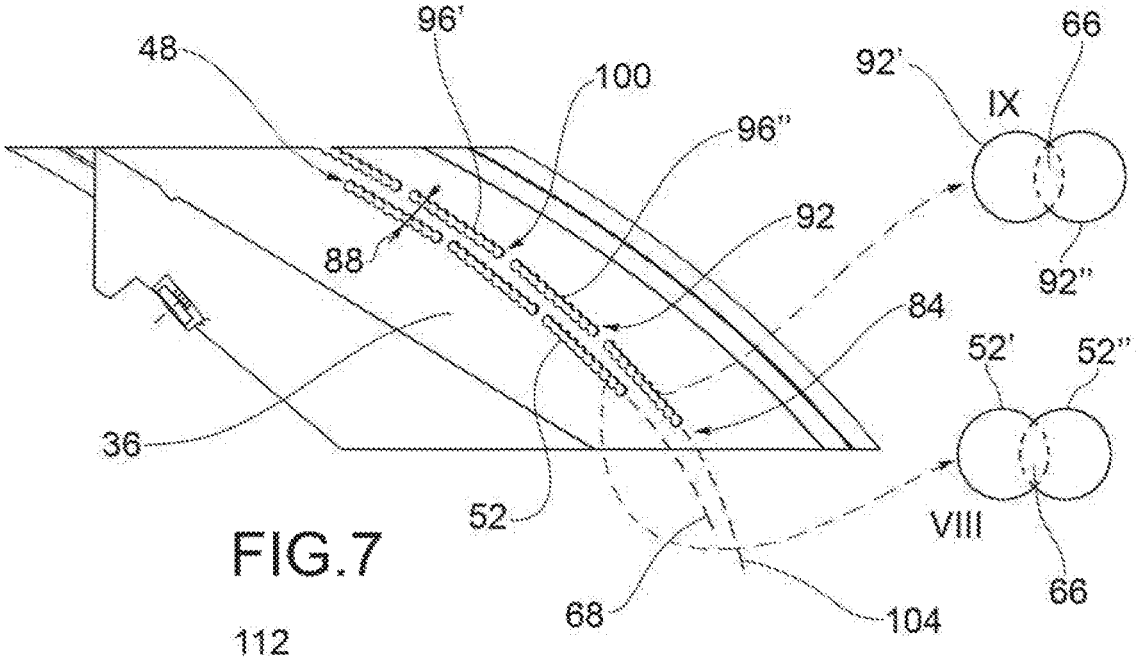
FIG. 7 is a plan view of component IV in FIG. 4 from the side of arrow VII.
Figure 5:
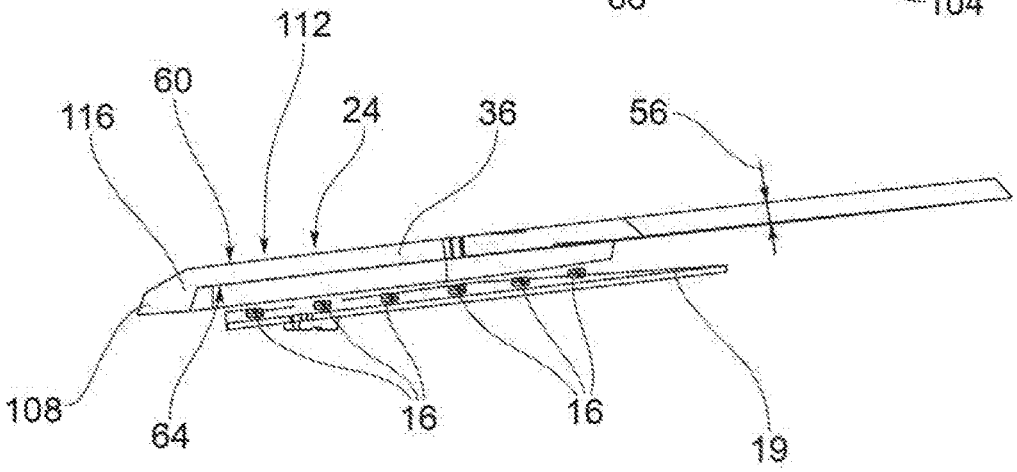
FIG. 5 is a lateral view of component IV in FIG. 4 from the side of arrow V.

As mentioned, the first holes 52 are substantially tangential or at most at least partially interpenetrating each other, e.g. for a circular sector 66 equal to 1 to 10% of their total area, measured with respect to a section plane perpendicular to a first hole axis X-X (see enlarged detail VIII in FIG. 7, relating to two first adjacent holes 52', 52").

It should be noted that the tangency or the interpenetration of the holes may depend on the production process: laser drilling results in substantially tangential holes, whereas an injection molding process tends to assume an interpenetration of the same holes.

According to one embodiment, the first holes 52 are circular section holes, equidistant from each other and having the same diameter.

The first holes 52 may provide a slight flaring or draft angle to facilitate the extraction of the body 36 of the light guide 24 from the mold.

The first breakline 48, with respect to a section plane perpendicular to the first axes X-X of the first holes 52, extends along a first curvilinear segment 68 substantially parallel to the light outlet wall 32.

The first curvilinear section 68 may also be straight.

According to one embodiment, body 36, on the light outlet wall 32 has a diffusive portion 72, comprising micro-optics and/or an embossment and/or a satin finish, suitable to uniformize and to spread the light beam that is emitted by the light outlet wall 32.

In other words, the diffuser portion 72 serves to blur the light until the contour of the holes 52, 92 is removed so as to block the only contribution provided by the aforementioned cylindrical or spherical optics.

Therefore, in order to get the opalescent effect, a synergy between first holes 52 and the diffusive portion 72 is necessary.

In fact, the first holes 52 perform, by use of successive refractions, a scattering of light rays Ri towards the light outlet wall 32, and the diffusive portion 72 fades to eliminate the profile of the first holes 52 so as to freeze the sole contribution given by cylindrical or spherical optics. In this way, the overall and uniform opalescent effect is obtained.

The diffusive portion 72 comprises micro-optics and/or an embossment and/or satin finish, suitable to uniformize and to spread the light beam that is emitted by the light outlet wall 32, may also be made on the lenticular body 20.

For example, the diffusive portion 72 extends in correspondence to a segment 76 of the light outlet wall 32 corresponding to the extension of the first breakline 48. In this way, the light rays diffused by the first breakline 48 are further homogenized in outlet from the light outlet wall 32.

Figure 4:
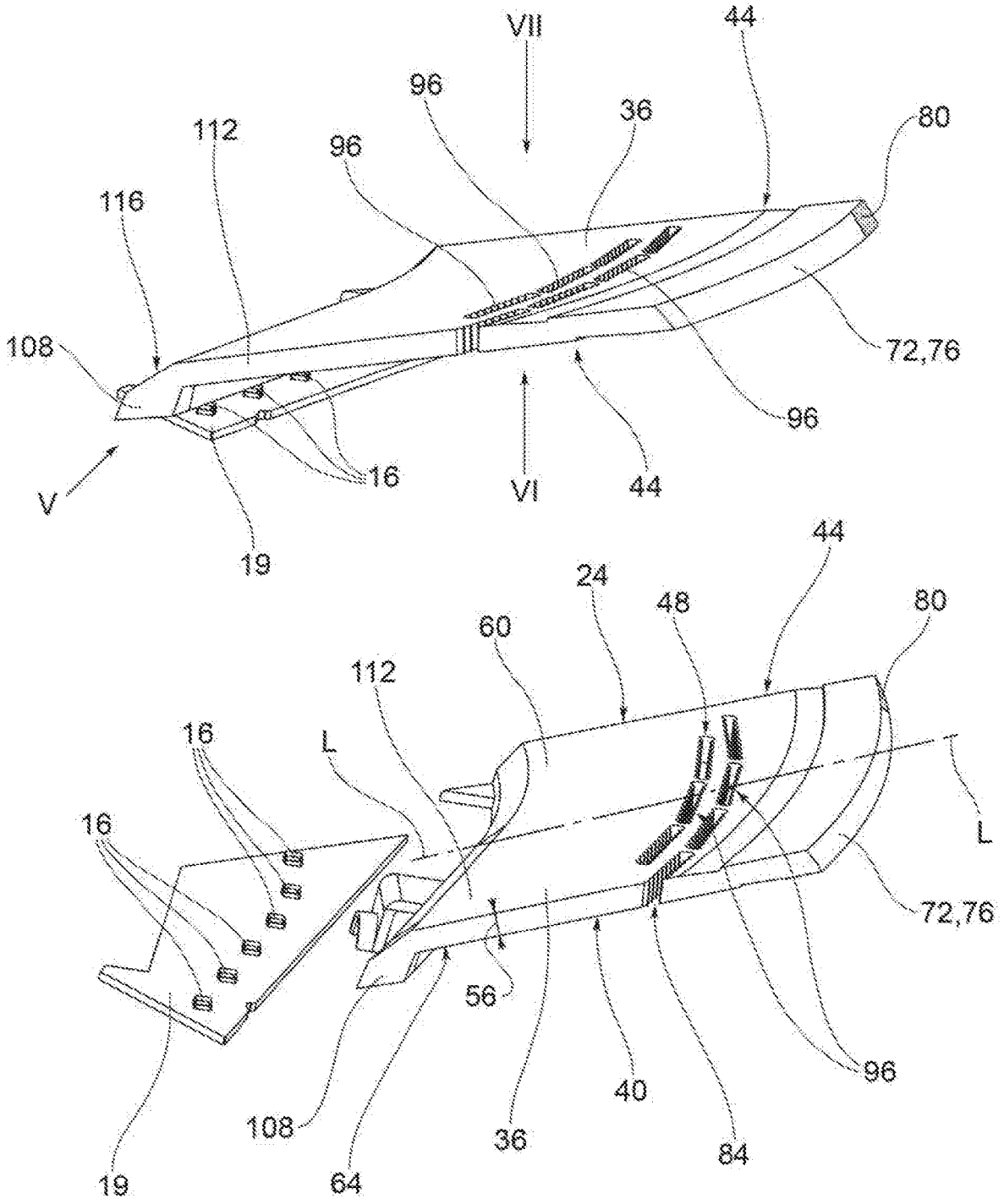
FIG. 4 is a perspective view of component IV shown in FIG. 3.
Figure 6:
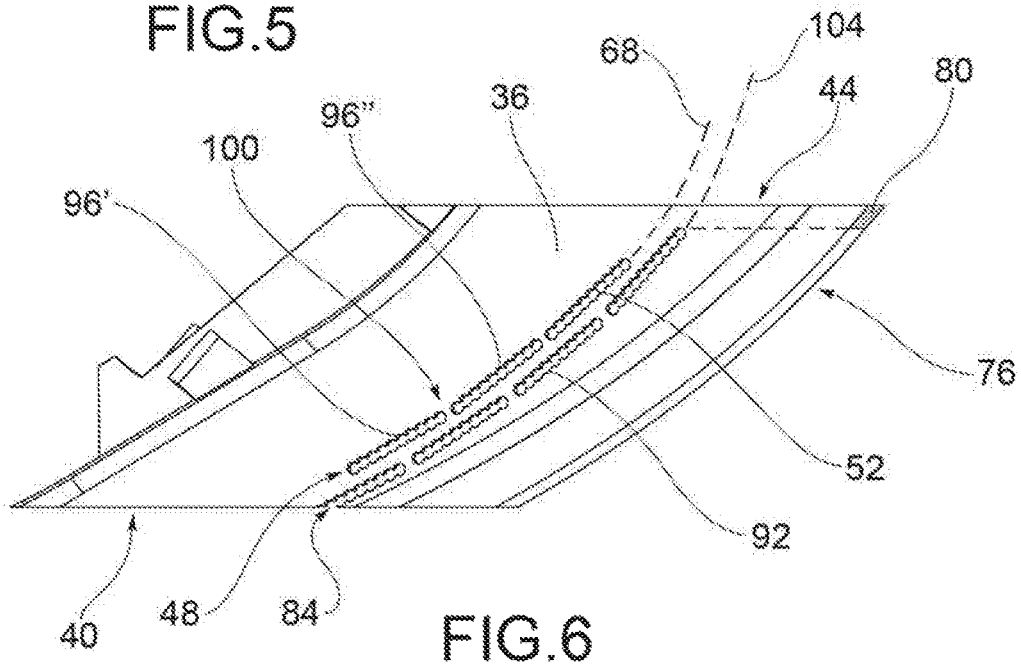
FIG. 6 is a plan view of component IV in FIG. 4 from the side of arrow VI.
Figure 10:
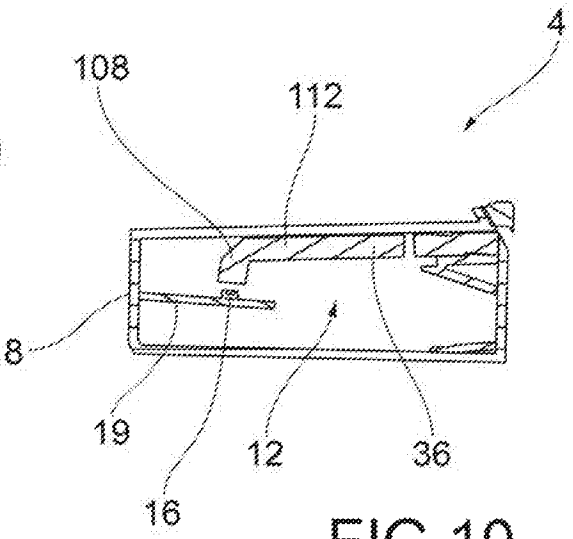
FIG. 10 is a sectional view of the vehicle light in FIG. 8, along the section plane X-X in FIG. 8.
Figure 9:
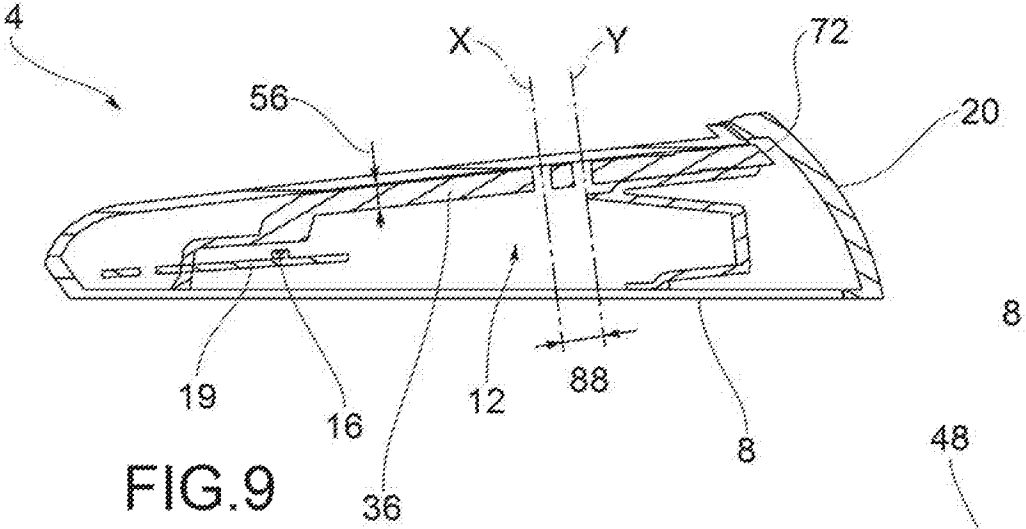
FIG. 9 is a sectional view of the vehicle light in FIG. 8, along the section plane IX-IX in FIG. 8.
Figure 8:
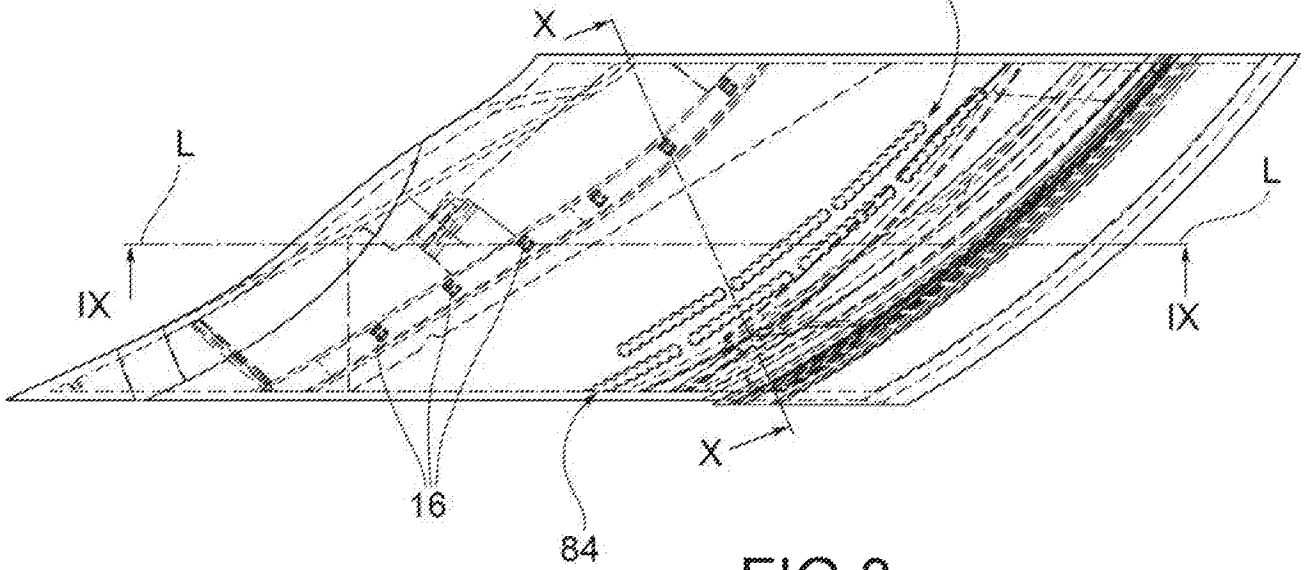
FIG. 8 is a plan view of a vehicle light according to the present invention.
Figure 11B:
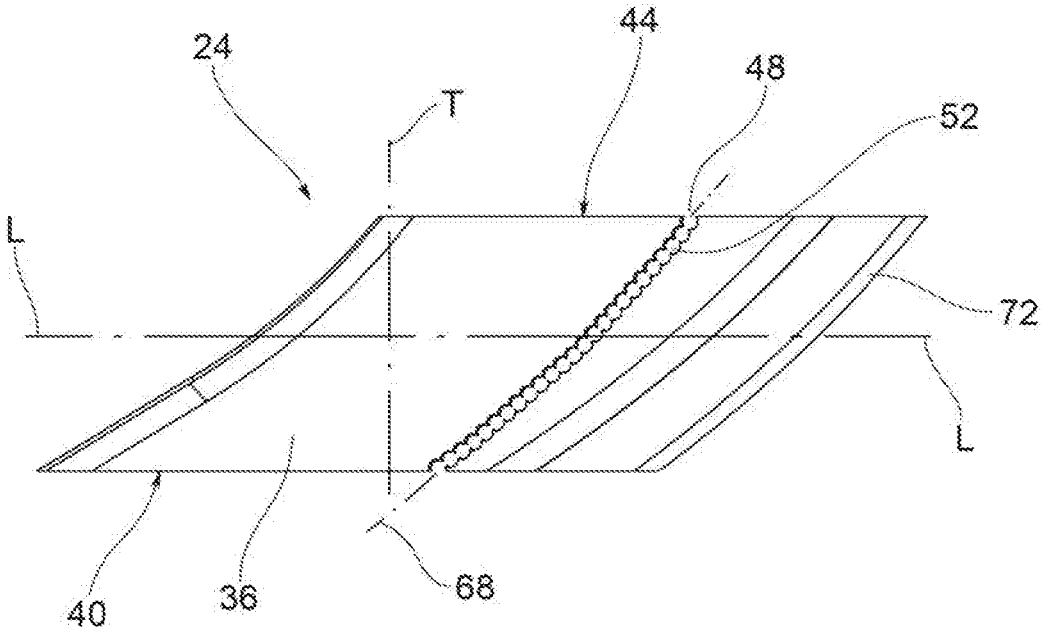
FIG. 11*b* is a plan view of a light guide of a vehicle light according to a further embodiment of the present invention.
Figure 11A:
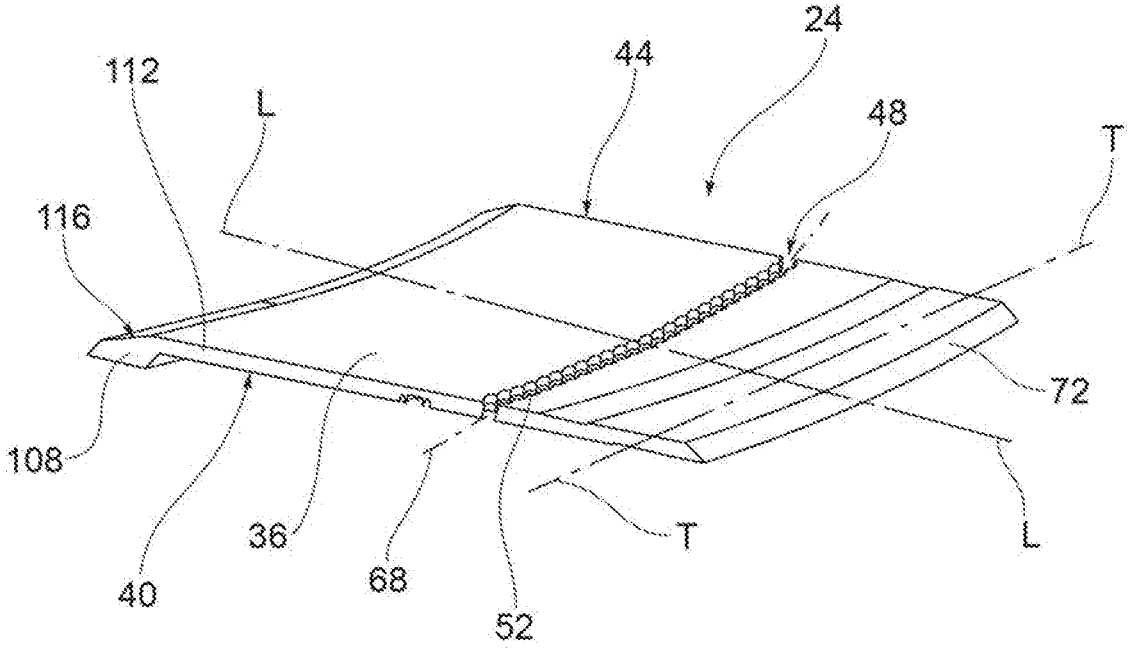
FIG. 11*a* is a perspective view of a light guide of a vehicle light according to a further embodiment of the present invention.

Body 36 on the light outlet wall 32 may have at least one mask 80 arranged at the body portion not affected by the first holes 52. The mask 80 being arranged so as not to be crossed by the light beams incident thereon (FIGS. 4, 6).

Figure 14:
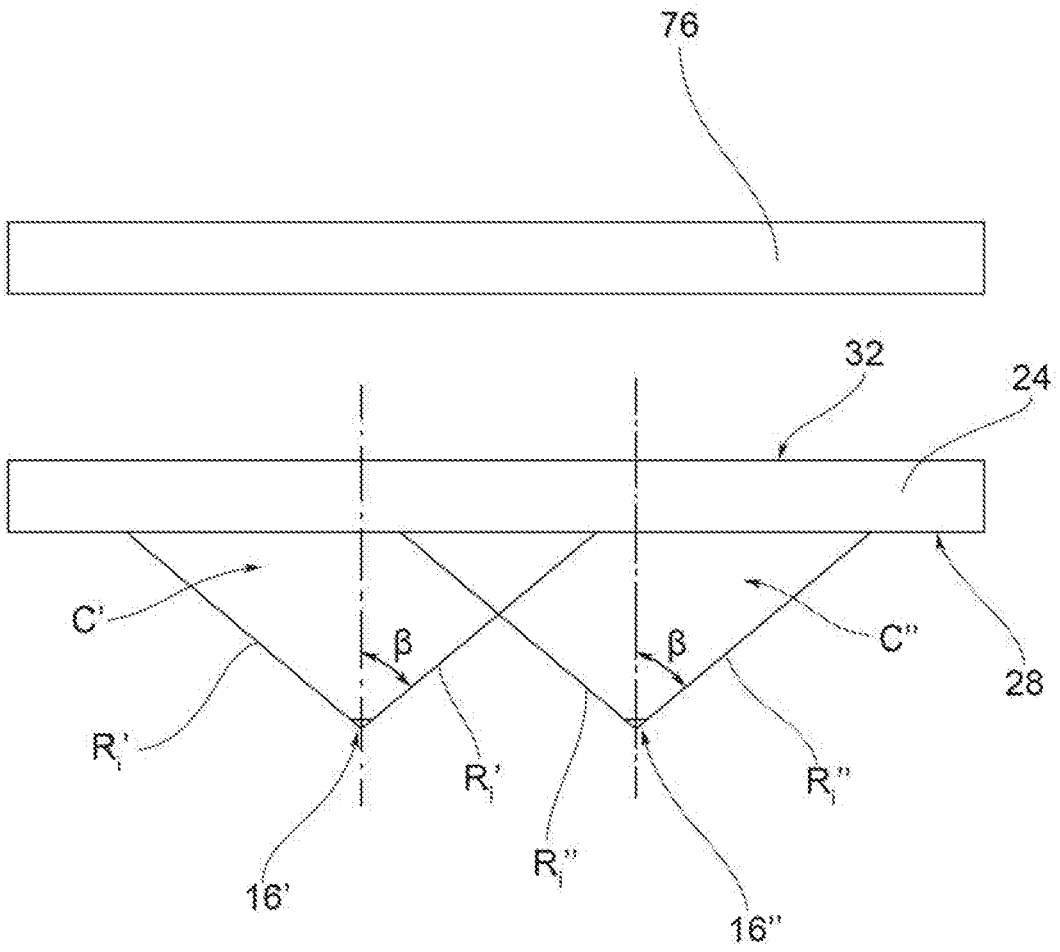
FIG. 14 is another schematic view of the optical behavior of a vehicle light according to the present invention.

Preferably, the container body 8 houses at least two light sources 16',16" suitable for emitting, when electrically powered, a plurality of light rays Ri', Ri" which expand according to bright cones c', c". The light sources 16', 16" are shaped and/or spaced apart so that two adjacent bright cones C', C" intersect at least partially on the diffusive body 24 (FIG. 14).

Preferably, the light cones C', C" intersect at the light input wall 28 of the diffusive body 24.

Thanks to the intersection of the luminous cones C', C" of adjacent light sources, it is possible to obtain the overall opalescent light effect.

According to one embodiment, body 36 has a second breakline 84 extending between the first and the second side wall 40, 44, in an offset position relative to the first breakline 48 along the direction of propagation of the light beam by a step 88.

The second breakline 84 comprises a plurality of second holes 92, defining cylindrical optics, having circular cross-section, or spherical optics suitable to produce cylindrical or spherical caustics that produce, through successive refractions, a scattering of the light rays Ri towards the light outlet wall 32.

The second holes 92 are side by side without interruption, so as to at least partially interpenetrate each other.

The second holes 92 of the second breakline 84 are pass-through with respect to thickness 56 of body 36 of the light guide 24, penetrating from the first face 60 to the second face 64 of body 36 by a depth equal to the thickness 56 of body 36.

The second holes 92 are at least partially staggered along a transverse direction T-T perpendicular to the direction of propagation of the light beam, with respect to the first holes 52 so as to affect portions of body 36 of the light guide 24 not affected by the first holes 52, with respect to the transverse direction T-T.

In other words, due to the offset between the first and second holes 52, 92 along the transverse direction T-T, it is ensured that the light beams cannot reach the light outlet wall 32 without first having intercepted at least the first or second breakline 48, 84; in yet other words, it is ensured that the light beams always intercept at least one hole, be it a first hole 52 or a second hole 92, before reaching the light outlet wall 32.

According to a possible embodiment, the first and/or second breakline 48, 84 comprise a plurality of groups of holes 96, separated from one another by interruptions or solid portions 100.

In other words, the breaklines 48, 84 may comprise groups of holes 96, within which the holes (be it first holes 52 or second holes 92) are at least partly interpenetrated without interruption; at the same time, adjacent groups of holes 96', 96" are separated by interruptions or solid portions 100.

Advantageously, the groups of holes 96 of the breaklines 48, 84 are staggered, with respect to the transverse direction T-T, so as to superimpose or align each interruption 100 of one of the breaklines 48, 84 with at least one hole 92, 52 of the other breakline 84, 48.

In this way, there is no possibility that a light ray Ri may reach the light outlet wall 32 without having first crossed at least one hole between the first holes 52 and the second holes 92.

According to an embodiment, the second holes 92 have a diameter ranging from 1 mm to 5 mm.

The second holes 92 are substantially tangential to one another or at most interpenetrating each other for a circular sector 66 equal to 1-10% of their overall area, measured with respect to a section plane perpendicular to a second hole axis Y-Y (see enlarged detail IX in FIG. 7, relating to two second adjacent holes 92', 92").

It should be noted that the tangency or the interpenetration of the holes may depend on the production process: laser drilling results in substantially tangential holes, whereas an injection molding process tends to assume an interpenetration of the same holes.

Preferably, the second holes 92 are circular section holes, equidistant from each other and having all the same diameter.

The second holes 92 may provide a slight flaring or draft angle in order to facilitate the extraction of the body 36 of the light guide 24 from the mold.

Preferably, the second holes 92 are the same as the first holes 52.

The second breakline 84, with respect to a section plane perpendicular to second axes Y-Y of the second holes 92, extends along a second curvilinear segment 104 substantially parallel to the light outlet wall 32.

The second curvilinear section 104 may also be rectilinear.

The step 88 between the first and second breaklines 48, 84, defined as the distance between the respective axes X-X and Y-Y of the first holes 52 and second holes 92, is equal to a value sufficient to guarantee the mechanical rigidity of the light guide 24, for example, equal to the diameter of the individual holes.

Interruption 100 is defined in such a way as to ensure the mechanical rigidity of the light guide 24.

According to one embodiment, the light source 16 is oriented so as to emit light along a direction orthogonal to the plane of alignment of the light guide 24. The body 36 of the light guide 24 extends therefore with a first and a second branch 108,112 arranged preferably perpendicularly to each other so as to present overall an L-shape wherein the light inlet wall 28 and the light outlet wall 32 are substantially perpendicular to each other.

Reflecting elements may be arranged at an intersection portion 116 of the first and second branch 108,112, for example by metallization or lacquering, so as to reflect the light beam propagating within the first branch 108 toward the interior of the second branch 112 of body 36. Of course, in one variant of embodiment, the body 36 may include only the second branch 112, and the light source 16 is oriented so as to emit light in the direction along the length of the second branch 112.

The optical operation of a vehicle light according to the present invention will now be described, so as to clarify how the desired optical effect may be obtained by the suitable use of holes within the light guide.

Figure 12:
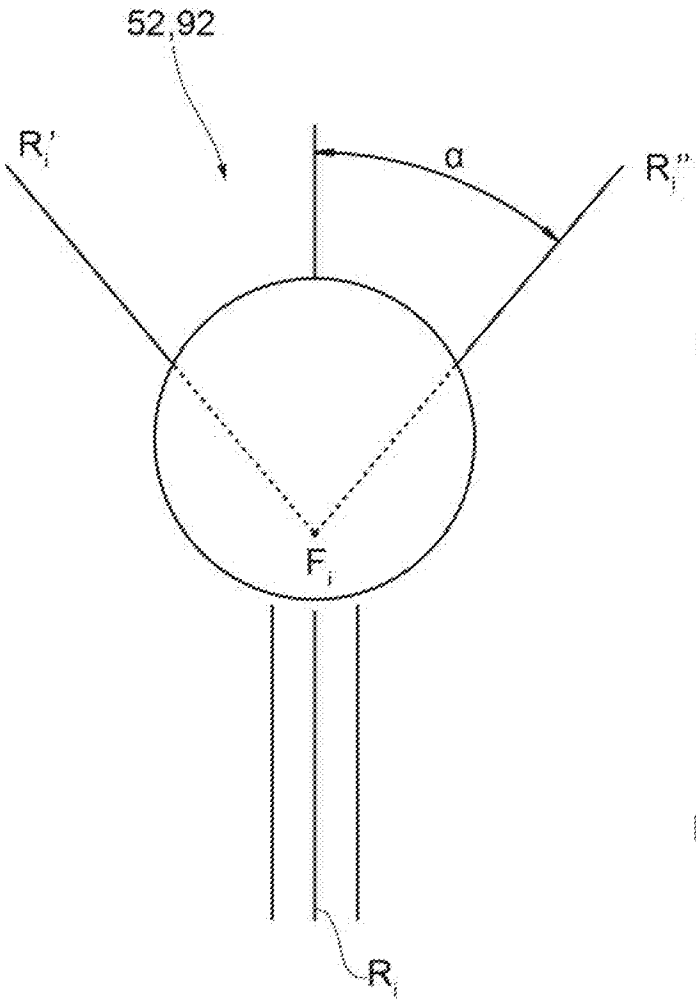
FIG. 12 is a schematic view of the optical behavior of a vehicle light according to the present invention.

In particular, FIG. 12 illustrates the behavior of a light beam having a direction parallel to a light ray Ri that strikes a hole (be it a first hole 52 or a second hole 92) and, by subsequent refractions and reflections, is deviated according to an angular distribution enclosed between two extreme output directions R'i, R"i.

The two refractions and reflections occur at the transition of the light beam from the material of the body to the air inside the hole and, subsequently, at the transition from the air to the material of the body. The beam is thus diffused in a light cone having an opening angle $2\alpha$ which depends on the materials of the means crossed by the light beam. For example, in the case of the body in PMMA or PC, this angle $\alpha$ is equal to approximately 40 degrees. Such a light cone has an apparent origin inside a virtual focus Fi lying inside the hole.

Figure 13:
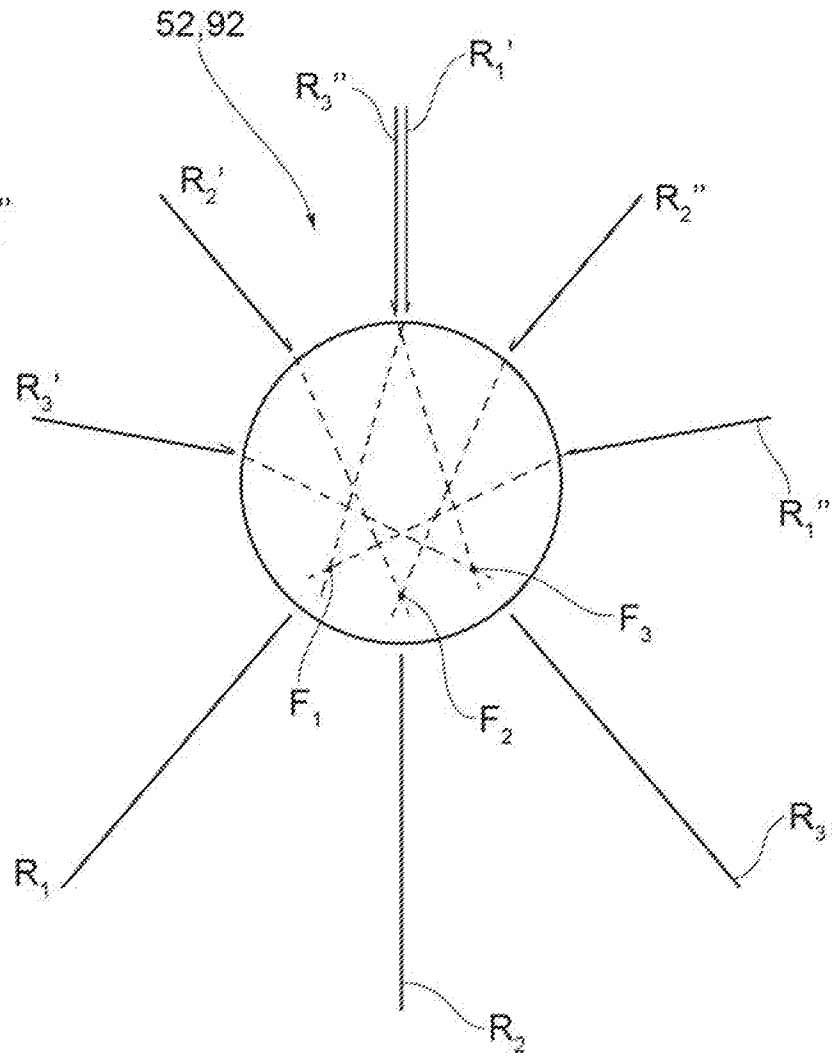
FIG. 13 is another schematic view of the optical behavior of a vehicle light according to the present invention.

FIG. 13 illustrates the same optical diffusion scheme for three distinct light beams each having a direction parallel to a light ray R1, R2, R3 coming from different directions within the light guide 24 and strikes the same hole.

Each of the beams is diffused into a light cone having an opening angle $2\alpha$ which is dependent on the materials of the means crossed by the light beam. In particular, each light beam having a direction parallel to a light ray R1, R2, R3 strikes a hole and, for subsequent refractions and reflections, is deviated according to an angular distribution enclosed between two extreme output directions R'1, R"1, R'2, R"2, R'3, R"3, respectively.

In addition, each light ray R1, R2, R3 identifies a light cone of $2\alpha$ brightness inside a respective virtual focus F1, F2, F3 lying inside the hole.

The overlapping of such light cones R'i, R"i coming from different directions makes it possible to obtain a distribution of light at the outlet of the hole, substantially Lambertian, almost identical to the volume scattering typically produced by an opaline material.

As can be appreciated from the description, the present invention allows overcoming the drawbacks of the prior art.

In particular, the light according to the present invention allows any opalescent-effect light pattern to be obtained without the use of any layer of opaline material on the outer lenticular body of the light or on the light guide.

In particular, the geometry of the holes develops spherical or cylindrical caustics that exploit the phenomenon of light refraction crossing different means, i.e., the plastic material of the light guide and the air within the holes themselves. In this way, the incident light beam on the holes is opened with an angle dependent on the materials crossed and is distributed randomly so as to spread and scatter the light, obtaining, as seen, the cited opalescent effect.

Obviously, the light of the present invention is capable of absolving all the photometric specifications of the light and is able to emit a light beam that is homogeneous and pleasing to the eye of an observer.

In conclusion, the vehicle light of the present invention, while not providing the use of the opalescent materials of the prior art, simultaneously allows obtaining a uniform beam with opalescent effect.

A man skilled in the art, in order to meet contingent and specific requirements, may make numerous modifications and variations to the vehicle light described above, all of which are within the scope of the invention as defined by the following claims.

The invention claimed is:

1. A vehicle light comprising a container body that delimits a containment seat that houses at least one light source suitable to emit, when electrically powered, a plurality of light rays (Ri) defining a light beam to propagate outside of the vehicle light, a lenticular body, that at least partially closes the containment seat and is suitable to be crossed by said light beam produced by the light source, a light guide facing, in correspondence of a light inlet wall, to said at least one light source, so as to receive the light beam from this and transmit it to a light outlet wall, facing the lenticular body, wherein the light guide comprises a body having a prevailing longitudinal extension (L) that defines the propagation direction of the light beam inside the body by total internal reflection, a first and a second side wall substantially parallel to said prevailing longitudinal extension (L), wherein the body, on the light outlet wall has a diffusive portion, comprising micro-optics and/or embossing and/or a satin finish, suitable to standardise and spread the light beam exiting from the light outlet wall, wherein the body has a first breakline that extends along a direction from the first to the second side wall, the first breakline comprising a plurality of first holes, defining cylindrical optics, having circular cross-section, or spherical optics suitable to realise cylindrical or spherical caustics that produce, through successive refractions, a scattering of said light rays (Ri) towards the diffusive portion of the light outlet wall so as to emit a light beam with opalescent effect, wherein said first breakline comprises a plurality of a group of first holes and the first holes of each group are adjacent to each other without interruption, and wherein said first holes of the first breakline are pass-through with respect to a thickness of the body of the light guide, penetrating from a first face to a second face of the body for a depth equal to said thickness.

2. The vehicle light as set forth in claim 1, wherein said first holes have a diameter between 1 mm and 5 mm.

3. The vehicle light as set forth in claim 1, said first holes are substantially tangential or interpenetrating each other for a circular sector equal to 1-10% of their total area, measured with respect to a section plane perpendicular to a first axis (X-X) of the first holes.

4. The vehicle light as set forth in claim 1, wherein said first holes are holes of circular section, equidistant from each other and all having the same diameter.

5. The vehicle light as set forth in claim 1, wherein the first breakline, with respect to a section plane perpendicular to the first axes (X-X) of said first holes, extends along a first segment substantially parallel to the light outlet wall.

6. The vehicle light as set forth in claim 1, wherein said diffusive portion extends in correspondence of a segment of the light outlet wall corresponding to the extension of the first breakline.

7. The vehicle light as set forth in claim 1, wherein the plurality of groups of first holes of the first breakline are separated from one another by interruptions or solid portions.

8. The vehicle light as set forth in claim 1, wherein the container body houses at least two light sources suitable for emitting, when electrically powered, a plurality of light rays (Ri', Ri") which expand according to bright cones (C', C"), the light sources being shaped and/or spaced apart so that two adjacent bright cones (C', C") intersect at least partially on the diffusive portion of the light guide body.

9. The vehicle light as set forth in claim 8, wherein said bright cones (C', C") intersect on the light inlet wall of the diffusive portion of the light guide body.

10. The vehicle light as set forth in claim 1, wherein the body has a second breakline which extends along the direction from the first to the second side wall, in an offset position with respect to the first breakline along the direction of propagation of the light beam by a step, the second breakline comprising a plurality of second holes defining cylindrical, or spherical, optics suitable to realise cylindrical or spherical caustics suitable to produce, through successive refractions, a scattering of said light rays (Ri) towards the light outlet wall, wherein said second breakline comprises a plurality of groups of second holes and the second holes of each group are adjacent to each other without interruption, and wherein said second holes of the second breakline are pass-through with respect to a thickness of the body of the light guide, penetrating from the first face to the second face of the body.

11. The vehicle light as set forth in claim 10, wherein said second holes are at least partially staggered along a transverse direction perpendicular to the direction of propagation of the light beam, with respect to the first holes so as to affect portions of the body of the light guide not affected by the first holes with respect to the transverse direction (T-T).

12. The vehicle light as set forth in claim 10, wherein the plurality of groups of first holes of the first breakline and/or the plurality of groups of second holes of the second breakline are separated from one another by interruptions or solid portions.

13. The vehicle light as set forth in claim 12, wherein the plurality of groups of first holes and the plurality of groups of second holes of said first and second breaklines are staggered, with respect to the transverse direction (T-T), so as to superimpose or align each interruption of one of said breaklines with at least one hole of the other breakline.

14. The vehicle light as set forth in claim 10, wherein said second holes have a diameter between 1 mm and 5 mm.

15. The vehicle light as set forth in claim 10, wherein said second holes are substantially tangential or interpenetrating each other for a circular sector equal to 1-10% of their total area, measured with respect to a section plane perpendicular to a second axis (Y-Y) of the second holes.

16. The vehicle light as set forth in claim 10, wherein said second holes are holes of circular section, equidistant from each other and all having the same diameter.

17. The vehicle light as set forth in claim 10, wherein said second holes are the same as said first holes.

18. The vehicle light as set forth in claim 10, wherein the second breakline, with respect to a section plane perpendicular to second axes of said second holes, extends along a second curvilinear segment substantially parallel to the light outlet wall.

19. The vehicle light as set forth in claim 10, wherein the step between the first and the second breakline is equal to the diameter of said first or second holes.

20. The vehicle light as set forth in claim 1, wherein the body of the light guide comprises a first and a second branch arranged perpendicularly to each other so as to present an overall L-shape wherein the light inlet wall and the light outlet wall are substantially perpendicular to each other.

* * * * *